United States Patent [19]

Takahashi et al.

[11] 4,279,443

[45] Jul. 21, 1981

[54] MINING APPARATUS

[75] Inventors: Ken Takahashi, Tokyo; Tsunetoshi Ito, Yokohama, both of Japan

[73] Assignee: Taiheiyo Engineering, Tokyo, Japan

[21] Appl. No.: 83,871

[22] Filed: Oct. 11, 1979

[30] Foreign Application Priority Data

Jul. 13, 1979 [JP] Japan ..... 54-88090

[51] Int. Cl.[3] ..... E21C 35/08

[52] U.S. Cl. ..... 299/1; 175/45

[58] Field of Search ..... 299/1, 45; 175/45

[56] References Cited

U.S. PATENT DOCUMENTS

| | | | |
|---|---|---|---|
| 3,719,394 | 3/1973 | Hartley | 299/1 |
| 4,072,349 | 2/1978 | Hartley | 299/1 |

FOREIGN PATENT DOCUMENTS

| | | | |
|---|---|---|---|
| 1165270 | 9/1969 | United Kingdom | 299/45 |
| 1203362 | 8/1970 | United Kingdom | 299/1 |

*Primary Examiner*—Ernest R. Purser

*Attorney, Agent, or Firm*—Jordan and Hamburg

[57] ABSTRACT

The present invention is directed to a mining apparatus including a device comprising at least one pair of projectors for determining position of the apparatus in a mine by the intersection of paths from the projectors.

11 Claims, 5 Drawing Figures

MINING APPARATUS

BACKGROUND OF THE INVENTION

The present invention relates to a shearer for use in coal or metal mining and suitable for effecting the long wall mining method. More particularly, the present invention relates to a shearer provided with a device for detecting the position of a lower cutting drum according to the height which the long wall face or coal or metal mine is cut by another upper cutting drum so as to always keep the mining height constant.

Ranging drum shearers are well known as conventional coal mining machines and the shearers of this kind can be divided in to two groups, one of which is a single ranging drum shearer provided with a ranging arm only at one end of shearer and having a cutting drum, while the other, is a double ranging drum shearer provided with ranging arms at both ends of the shearer having cutting drums.

Since the single ranging drum shearer has only one cutting drum, generally speaking, it is difficult to cut the whole height of the seam by one pass of said shearer. Accordingly, it is necessary to reciprocate the shearer along the pit face changing the height of the shearer every pass along the pit face.

On the other hand, the double ranging drum shearer has ranging arms provided at the front and back ends of the shearer, each ranging arm having one cutting drum. Therefore, the preceding drum is positioned high to function as a drum for cutting the pit face at the side of the mine roof and the other succeeding drum is positioned low to function as another drum for cutting the pit face at the side of the mine floor, thus enabling the shearer to cut the entire seam height at one time.

In order to cut the pit face using the double ranging drum shearer, the operator must judge by himself whether or not the cutting operation is correct by viewing the top of the cutting drum arranged at the side of the mine roof and the bottom of another cutting drum arranged at the side of the mine floor. The cutting operation of the drum arranged at the side of mine roof provides no problem since the top of the drum can be easily viewed. However, the cutting operation of another drum arranged at the side of the mine floor depends on the skill of the operator since the bottom of the drum cannot be easily viewed because of the presence of coal previously cut by the preceding cutting drum and scattered on the mine floor and also because of the presence of a conveyor arranged on the mine floor along the pit face. Therefore, when the shearer is operated by an unskilled operator, the main floor is either made uneven, having wave-formed concave-convex portions, or the distance between the mine roof and floor, i.e., the mining height, is either exceeded by the maximum height of self-advancing supports or made lower than the minimum height of self-advancing supports, so that the working operation at the pit face is hindered and the mining efficiency is lowered.

In order to overcome the above-mentioned drawbacks, the inventors of the present invention previously disclosed a new technique in their publicly opened Japanese Pat. No. 958,841. This technique comprises attaching a sensor to the head of a ranging arm of a cutting drum arranged at the side of the mine roof, said sensor to use the change in the elasticity of a spring or oil pressure by the pantograph or diaphragm manner and arranged to contact and follow the mine roof surface to detect the change in the shape of the mine roof surface. Accordingly, the other cutting drum arranged at the side of the mine floor is raised or lowered responding to the signals transmitted from the sensor to thereby keep the mining height constant. However, according to this technique, the succeeding lower cutting drum is raised or lowered responding to the changes in the mine roof height detected by the sensor arranged to the preceding upper cutting drum, and the mining height is therefore not maintained accurately, because the preceding and succeeding cutting drums are arranged at both ends of the shearer body with a certain space interposed therebetween and the succeeding lower cutting drum is raised or lowered instantly responding to the information detected by the sensor which is arranged to the upper cutting drum several meters ahead of the succeeding lower cutting drum. In addition, the sensor is affixed attached to the head of the ranging arm. Therefore, when the ranging arm is raised or lowered, the sensor is also raised or lowered at the same time, so that the sensor is slanted, causing the measurement by this slanted sensor to have errors. Further, the sensor employed by this technique is arranged to contact and follow the mine roof surface. However, it is difficult to cause the sensor to contact and follow the concave-convex surface of the mine roof accurately. In addition, an accident can easily happen in this case.

SUMMARY OF THE INVENTION

The present invention is intended to eliminate the above mentioned drawbacks. Accordingly, an object of present invention is to provide a coal mining machine wherein a sensor for measuring the distance to the mine roof is arranged to a cutting drum arranged at the side of the mine floor, whereby the mining operation can be effected keeping the mining height accurately constant.

Another object of present invention is to provide a coal mining machine provided with a device for detecting the position of a cutting drum to cut the lower portion of the coal seam, said device comprising a sensor arranged to move parallel in the vertical direction without rotating even when the ranging arm to which the sensor is attached is raised or lowered, whereby the measurement errors caused by the conventional slanted sensor are eliminated.

A further object of present invention is to provide a coal mining machine provided with a device for detecting the position of a cutting drum, said device which serves to function as a sensor for measuring the distance to the mine roof comprising a means for projecting a ray or fluid whereby the distance to the mine roof can be accurately measured and the occurrence of accident is eliminated.

A still further object of present invention is to provide a coal mining machine provided with a device for detecting the position of cutting drum capable of easily keeping the mining height constant, so that a machine operator can easily operate the cutting drum to cut a lower portion of the coal seam by observing a cross point shown on a surface of the mine roof by rays or fluids projected from the projectors.

A still further object of present invention is to provide a coal mining machine provided with a device for detecting the position of a cutting drum wherein said device includes a parallel link means which includes a board to which the sensor for measuring the distance to the mine roof is attached and a ranging arm as two sides thereof, to prevent the sensor from being rotated or slanted whereby said device can be accurately operated even when the violent vibration of the coal mining machine or the impact of crumbling lumps or scattering pieces of coal is imparted to said device.

A still further object of present invention is to provide a coal mining machine provided with a device for detecting the position of a cutting drum wherein the board to which the sensor is attached is pivoted on the axial line of a drum rotating shaft of a ranging arm whereby the board is precisely moved upwardly or downwardly according to movement of the cutting drum.

These and other object as well as the merits of the present invention will be apparent from the following detailed description with reference to the accompanying drawings.

DETAILED DESCRIPTION OF PREFERRED EMBODIMENTS

Figure 1:
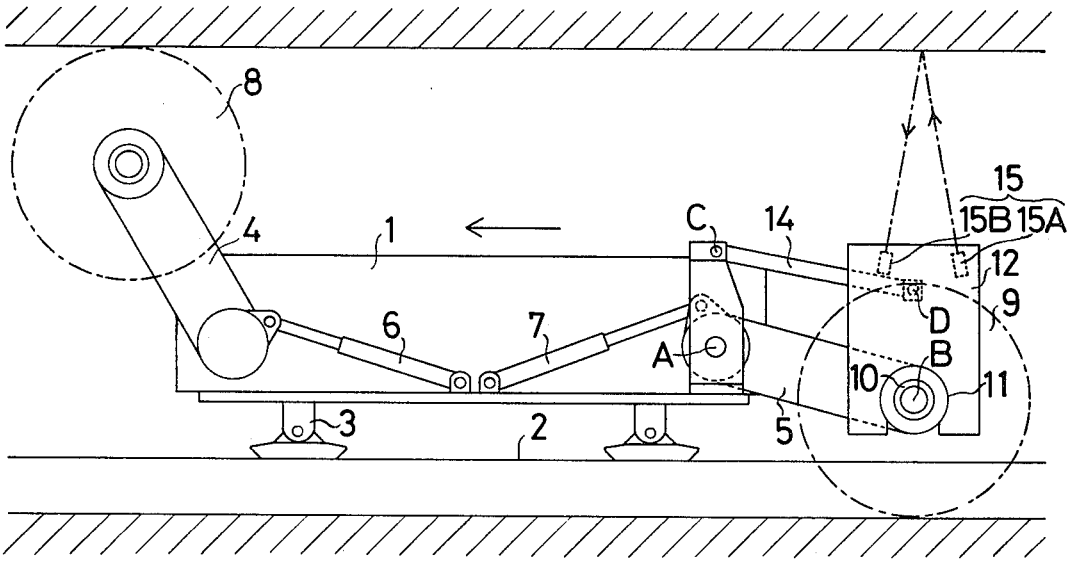
FIG. 1 is a front view showing an embodiment of present invention.
Figure 2:
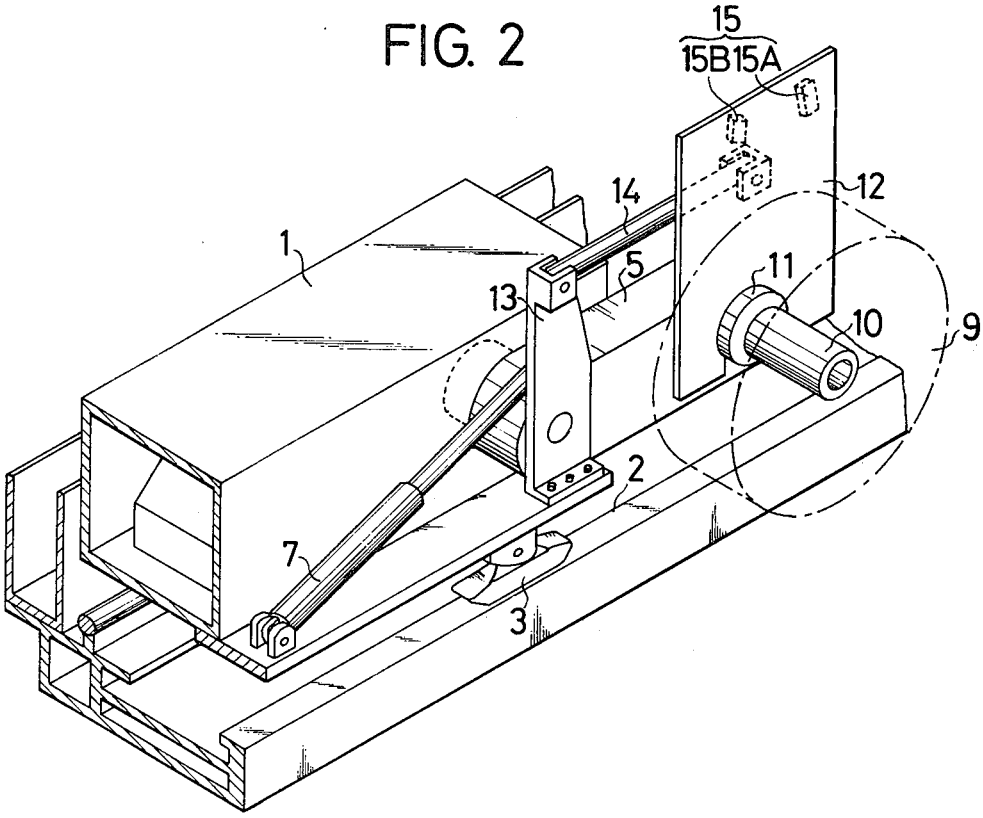
FIG. 2 is a partly broken isometric view showing the embodiment shown in FIG. 1.

FIGS. 1 and 2 show an example in which the present invention is applied to the double ranging drum shearer. Numeral 1 represents a shearer body, which is mounted on conveyors 2 with skids 3 interposed therebetween. In the shearer body 1 a means for driving cutting drums or the like is housed which will be described later. Numerals 4 and 5 represent ranging arms of which bottom ends are attached to both ends of shearer body 1, respectively. Numerals 6 and 7 denote ranging jacks, which serve to rotate the ranging arms 4 and 5. Numerals 8 and 9 denote cutting drums each being attached to the foremost end of the corresponding ranging arm through a rotating shaft 10.

Numeral 11 represents a bearing housing by which the rotating shaft 10 is held. Numeral 15 denotes a device for detecting the position of a cutting drum, said device comprising a means 15A, 15B for projecting a ray or fluid. The detection device 15 is arranged on a board 12, which is freely rotatably mounted on the bearing housing 11 of the foremost end of ranging arm 5. Numeral 13 represents a fixing plate erected on the shearer body 1 in front of the bottom end of ranging arm 5. Numeral 14 denotes a link bar, one end of which is pinned at a point C to the upper end of fixing plate 13 and the other end of which is pinned at a point D to the board 12. Points A, B, C and D are in the following positional relation. Namely, line A–B is equal in length and parallel to line C–D, and line A–C is equal in length and parallel to line B–D, thus forming a parallelogram. In this embodiment, lines A–C and B–D are always kept vertical. As apparent from above, a parallel link mechanism is formed by the ranging arm 5, fixing plate 13, link bar 14 and board 12. Accordingly, even when the jack 7 is operated to change the slant angle of ranging arm 5, the board 12 on which the detection device 15 is arranged is changed in an angle relative to the ranging arm 5 to always keep line B–D vertical. In other words, the board 12 is vertically moved corresponding to the extent to which the cutting drum 9 is raised or lowered.

Though the positions of points A, B, C and D can be freely changed so far as these points occupy any of the apexes of the parallelogram, it is desirable that the moving direction and amount of point D are equal to those of center of cutting drum 9. When point B is replaced in the direction of point A to form a parallelogram, the moving direction and amount of points B and D are not equal to those of the center of cutting drum 9, and therefore, it becomes necessary to add to the detection device 15 a complicated circuit or the like for correcting the measurement values. The above mentioned parallel link means of the present invention includes a kind of link means which does not form a parallelogram such as the present invention, but has equal function as the same as a parallel link in allowed measurement errors.

In the present invention, the detection device 15 comprises a sensor for measuring the distance to the mine roof which is attached to the board 12. This sensor 15 includes a projectors 15A, 15B for projecting a ray, fluid, for example water, colored air, powdered or grained material or the like, to the mine roof. The projector of this kind is publicly well known and the operation principle thereof is also publicly well known. Therefore, construction of the projector 15A and 15B employed in the present invention will be not described in detail but may be attached to the board 12 as described below.

The sensor 15 consists of at least one pair of the projectors 15A and 15B, each of which is mounted on the board 12 with desired projection direction and distance, with rays projected from the projectors 15A, 15B appearing as a cross point on surface of the mine roof. Because mining height occasionally changes according to condition of the coal or metal seam, it is therefore necessary to arrange a mechanism by which the cross point of the two projected rays is moved upwardly and downwardly. For this technical object, it is desired that at least one projector 15A or 15B is movably mounted on the board 12 to change projection direction or mounted point thereof.

Furthermore, more than two pairs of the projector may be mounted on the board 12. To prevent the projected ray from being intersepted by a part of the shearer, self-advancing support or materials around the projector 15A, 15B, many sets of the projector are separately mounted in different directions and mounted positions.

To project a visible ray of light, a flood light projector is used for the projector 15A, 15B. If fluid similar to water is projected, a nozzle continued to a water pump or the like through hoses is used for the projector. In case the projector projects visible aerial material similar to coloured air, a nozzle is continued to a source of supply of aerial material as an air compressor. Further, if the projector projects powdered or grained materials, a nozzle is jointed with a source of supply of said materials.

For example, if a flood light projector projecting visible ray is used for the projector 15A, 15B, each of projector 15A and 15B may project rays in different color and then the cross point of said rays is shown in mixed color.

In addition to the above, in this invention, it is unnecessary that the cross point O is indicated literally as a small point. Said cross point may be indicated as a sectioned portion having some square measurements.

The function of the sensor of the present invention constructed above will now be described.

Figure 3:
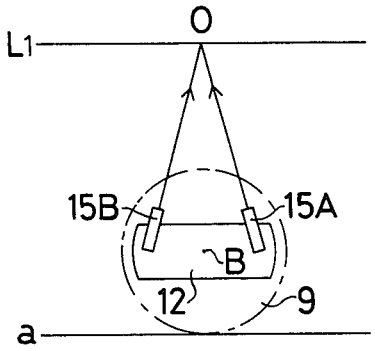
FIGS. 3 through 5 are explanatory views illustrating the function of detecting devices of present invention.

In FIG. 3, a level a is regulated for a desired cutting face of a lower portion of the coal or metal seam, when the mine roof is provided in level L1. Before beginning the coal mining, a position of the cutting drum 9 used to cut the lower portion of the coal or metal seam is previously set by moving the arm 5 upwardly downwardly in the level so that a bottom face of said drum 9 is on the level a. At the same time, two projectors 15A, 15B are regulated to cause visible rays or fluid projected from said projectors to cross on the surface of the mine roof L1. Accordingly, an operator operates the shearer at the same time that he detects through his eyes the cross point O of rays shown on the surface of the mine roof.

Figure 4:
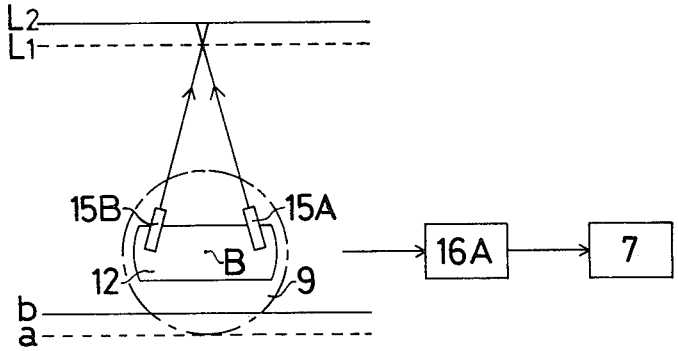

Next, while the shearer continues to cut the coal or metal mine, as shown in FIG. 4, when a level of the mine roof changes into a level L2 which is higher than the level L1, a cross point of the rays projected from the projectors 15A and 15B is not shown on the surface of the mine roof, because first level L1 of the mine roof is moved to new level L2. Accordingly, the cutting drum 9 should be raised to a level so that the cross point of the rays projected from the projectors 15A and 15B is shown on the surface of the mine roof. This operation is done by the shearer operator in the manner of operating a valve 16A, for example an electromagnetic valve, to raise a jack 7 of the cutting drum 9. At this time, the board 12 is also raised equal to the raised extent of the cutting drum 9 to come closer to the mine roof. When a new cross point of the rays become visible on new level L2 of the mine roof, the operator closes the valve 16A to stop raising of the jack 7, and the cutting drum 9 is regulated at the desired level.

Figure 5:
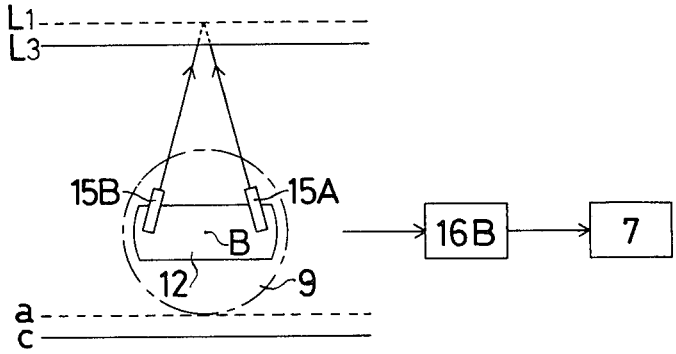

Further cutting is continued, and when the level of the mine roof changes into a lower level as shown at L3 in FIG. 5, the cross point disappears, and two points of the light now appear separately on the level L3. At this time, the shearer operator opens a valve 16B to lower the jack 7 and cutting drum 9. And just then, because the board 12 is mounted on the cutting drum 9, said board 12 is also lowered equal to the lowered extent of the cutting drum 9 to come nearer to the coal floor. In a short time, the board 12 is lowered, a new cross point of the rays appears on the new surface of the mine roof. When the operator detects the above new cross point, he closes the valve 16B to stop unwanted movement of the cutting drum 9. Through this operation, the cutting drum 9 is regulated according to new level L3 of the mine roof, and said cutting drum 9 shears a lower portion of the coal or metal seam according to an imagined lower level c.

By repeating the above operation, regardless of the height of the mine roof changing irregularly, coal or metal mining height is kept at desired constant height.

Though the present invention has been described in detail, it includes the following other embodiments:

(1) In the shearer having one ranging arm 5 which is provided with two cutting drums 9, the sensor attaching board 12 is mounted, as shown in FIG. 1, on the shaft to which the cutting drum to be arranged at the side of mine floor is attached.

(2) In the double ranging drum shearer as shown in FIG. 1, the device for detecting the position of a cutting drum according to the present invention is also arranged to the ranging arm 4 to which the cutting drum to be arranged at the side of mine roof is attached, so that either of cutting drum 8 and 9 can be used as the lower cutting drum reciprocating the shearer body 1 along the long wall pit face.

(3) The shearer is a single ranging one having no ranging arm 4 to which the cutting drum to be arranged at the side of mine roof is attached as shown in FIG. 1.

(4) Point (B) is not positioned on the drum rotating shaft 10, but is replaced a little to the side of point (A) on a line connecting points (B) and (A), and correction of measured values is made by a controller, not shown.

(5) Lines connecting points (A), (B), (C) and (D) do not form a correct parallel link means, but a quasi-parallel link means capable of keeping the measurement errors of the sensor smaller than several centimeters, preferably five centimeters.

(6) As disclosed in the Japanese Patent Publication No. 53-4043, the shearer has a main ranging arm to which a sub-ranging arm is attached, and two cutting drums are attached to both ends of the sub-ranging arm. In this case, two parallel links are formed as shown in FIG. 5 and the sensor attaching board 12 is mounted on the shaft to which the cutting drum to be arranged at the side of mine floor is attached. When either the main or sub-ranging arm is fixed, it is enough to form one parallel link.

(7) A plurality of sensors 15 are attached to the board 12 and the average of values measured by these sensors 15 is employed to represent the distance to the mine roof.

(8) One end of link bar 14 is pivoted to the shearer body 1.

(9) A plurality of position detection devices are arranged to prevent the ray or wave from being intercepted by any obstacle at the mining site.

It is thought that the present invention can be applied as follows: Instead of board 12 and parallel link means employed in the present invention, other publicly well-known levels which use the surface of liquid or a float, or are of hanging or swinging weight type, or of gyro-type for example, are employed and the sensor 15 is attached to one of these levels.

The coal mining machine according to the present invention and having such arrangements as described above can be operated as follows:

When the shearer body 1 is moved along the long wall pit face in the direction shown by an arrow in FIG. 1, the ranging arm 4 is turned in the upper direction to determine the position of cutting drum 8 which is intended to cut the coal seam at the side of mine roof, and then the coal seam at the side of mine roof is cut by the cutting drum 8. The coal seam at the side of the mine floor is cut by the following lower cutting drum 9 in such a way that the sensor 15 measures the distance to the mine roof as described above, namely the distance to the roof of the coal seam which has been cut by the preceding upper cutting drum 8, and the cutting drum 9 is manually or automatically raised or lowered according to the height of the mine roof. Accordingly, the mining height can be always kept constant.

Since the present invention can provide the above mentioned arrangements and operational functions, the objects of present invention can be attained. Namely, since the sensor for measuring the distance to the mine roof is arranged to the lower cutting drum, the distance to the mine roof can be accurately measured at the time of cutting the coal seam at the side of mine floor. Since the sensor is attached to the board which is kept moving in the vertical direction even if the ranging arm is rotated in the upper or lower direction, measurement errors are not caused because the sensor is not slanted as the conventional sensors are. Since the parallel link means is employed as a means to keep the sensor attaching board level, the sensor can be accurately operated even if violent vibration and impact of crumbling lumps and scattering pieces of coal are imparted to the shearer at the mining site. In addition, since the ray or fluid projector is employed as the sensor, the distance to the mine roof can be accurately measured even if the distance between the mine roof and the lower cutting drum is great, and accidents can be substantially reduced as compared with the conventional sensors which are designed to contact and follow the mine roof.

What is claimed is:

1. A mining apparatus comprising (A) an apparatus body, (B) a drum rotating shaft, (C) a board connected to said rotating shaft, (D) a linking bar pivotably connecting said apparatus body with said board, and (E) a position detection device mounted on said board comprising at least one pair of projectors with the intersection of paths from said projectors at a distance away from said position detection device determining the position of said apparatus in a mine.

2. An apparatus of claim 1 additionally comprising a ranging arm pivotally connected said rotating drum shaft with said apparatus body and adapted to move substantially in concert with said linking bar.

3. An apparatus of claim 2 wherein the position detection device projects rays.

4. An apparatus of claim 3 wherein the position detection device projects fluid rays.

5. An apparatus of claim 4 wherein said linking bar is substantially rigid.

6. An apparatus of claim 5 wherein said ranging arm and said linking bar are adapted to move substantially parallel to one another.

7. An apparatus of claim 5 wherein said linking bar and said ranging arm are connected to a fixed plate of said apparatus body which together with said board, said linking bar and said ranging arm, substantially forms a parallelogram on movement of said latter three components.

8. An apparatus of claim 2 wherein said ranging arm is attached to two drum rotating shafts and said position detection device is adapted to detect position of at least one cutting drum mounted on said drum rotating shafts.

9. An apparatus of claim 8 wherein said position detection device is adapted to detect position of said cutting drums mounted on both of said drum rotating shafts.

10. An apparatus of claim 1 wherein the position detection device comprises a plurality of projectors mounted in different directions.

11. The apparatus of claim 1 wherein said position detection device is adapted to measure position from the surface of a mine other than the surface which a drum positioned on the rotating shaft (B) is contacting.

* * * * *